US012692030B2

(12) United States Patent
Thomas

(10) Patent No.: US 12,692,030 B2
(45) Date of Patent: Jul. 28, 2026

(54) VACUUM FILLING SYSTEM

(71) Applicant: PLF INTERNATIONAL LIMITED, Ardleigh (GB)

(72) Inventor: Robert E. Thomas, Sudbury (GB)

(73) Assignee: PLF INTERNATIONAL LIMITED, Ardleigh (GB)

( * ) Notice: Subject to any disclaimer, the term of this patent is extended or adjusted under 35 U.S.C. 154(b) by 53 days.

(21) Appl. No.: 18/691,391

(22) PCT Filed: Sep. 20, 2022

(86) PCT No.: PCT/IB2022/058893
§ 371 (c)(1),
(2) Date: Mar. 12, 2024

(87) PCT Pub. No.: WO2023/042185
PCT Pub. Date: Mar. 23, 2023

(65) Prior Publication Data

US 2025/0136309 A1 May 1, 2025

Related U.S. Application Data

(60) Provisional application No. 63/261,402, filed on Sep. 20, 2021.

(51) Int. Cl.
*B65B 1/04* (2006.01)
*B65B 1/28* (2006.01)
(Continued)

(52) U.S. Cl.
CPC ..... *B65B 1/04* (2013.01); *B65B 1/28* (2013.01); *B65B 31/044* (2013.01); *B65B 43/50* (2013.01)

(58) Field of Classification Search
CPC ..... B65B 1/04; B65B 1/28; B65B 31/044; B65B 43/50; B65B 59/005; B65G 47/846
See application file for complete search history.

(56) References Cited

U.S. PATENT DOCUMENTS 4,976,296 A 12/1990 Pope
7,108,025 B2 * 9/2006 Bernhard ..... B67C 3/244 141/144
(Continued)

FOREIGN PATENT DOCUMENTS

CN 102673812 A 9/2012
CN 103662124 A 3/2014
(Continued)

OTHER PUBLICATIONS

International Search Report and Written Opinion mailed Jan. 18, 2024, issued in corresponding International Application No. PCT/IB2022/058893, 8 pages.
(Continued)

*Primary Examiner* — Timothy L Maust
(74) *Attorney, Agent, or Firm* — Christensen O'Connor Johnson Kindness PLLC

(57) ABSTRACT

A filling apparatus 20 includes a filler table structure 22 disposed within a protective and supporting main housing 24. The filler table structure 22 receives and supports containers 26 to be filled with product from filler heads 28 positioned above the filler table structure. The containers 26 to be filled arrive at the filler table structure 22 on infeed conveyances 30 and then are precisely positioned at a filling position beneath the filler heads 28 by indexing systems 32. Thereafter, the filled containers 26 are transferred by the indexing systems 32 to an out feed conveyance 34. Each filler head 28 is capable of cycling at a speed of at least 30 times per minute, whereby the filling station 20 is capable of filling containers 26 at a rate of at least 30 containers per minute per filler head.

15 Claims, 13 Drawing Sheets

(51) Int. Cl.
*B65B 31/04* (2006.01)
*B65B 43/50* (2006.01)

(56) References Cited

U.S. PATENT DOCUMENTS

| | | | | |
|---|---|---|---|---|
| 7,347,231 | B2 * | 3/2008 | Schmoll | B67C 3/06 141/144 |
| 7,823,717 | B2 * | 11/2010 | Zanini | B67C 7/0053 198/470.1 |
| 7,967,127 | B2 * | 6/2011 | Spence | B65G 47/847 198/723 |
| 2008/0072995 | A1 * | 3/2008 | Jenne | B67C 3/2617 141/311 A |
| 2017/0001848 | A1 * | 1/2017 | DiCarlo | B67C 3/24 |

FOREIGN PATENT DOCUMENTS

| | | | |
|---|---|---|---|
| CN | 110525704 | A | 12/2019 |
| CN | 111 071 771 | A | 4/2020 |
| GB | 632517 | A | 11/1949 |
| GB | 862 227 | A | 3/1961 |
| JP | H1135005 | A | 2/1999 |

OTHER PUBLICATIONS

First Examination Report mailed Dec. 24, 2025, issued in corresponding New Zealand Application No. 810282, filed Sep. 20, 2022, 3 pages.
First Office Action mailed Mar. 10, 2026, issued in corresponding Chinese Patent Application No. 202280063552.X, filed Sep. 20, 2022, 18 pages.

* cited by examiner

VACUUM FILLING SYSTEM

CROSS-REFERENCE TO RELATED APPLICATION

This application claims the benefit of U.S. Provisional Application No. 63/261,402 filed Sep. 20, 2021, the entire contents of which are incorporated herein by reference.

BACKGROUND

Current systems for filling containers with powder or granular product use a rotating wheel or a linear push system to place empty containers in position beneath a filling head for filling. Such systems operate at a relatively slow speed, approximately filling 10 containers per minute per filling head used. A limitation of current filling systems is that vacuum is used not only for evacuating the container during filling container, but also for operating the filling head to control the flow of product to the container, as well as for operating the seal required between the bottom of the filling head and the rim of the container. As a result, significant vacuum capacity is required.

The present disclosure seeks to provide a filling system capable of filling 30 containers per minute per filling head. This is achieved in part by replacing one or more functions of the filling system so as to not to require vacuum for operation.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a filling station is provided for filling containers of different sizes with product. The filling station includes a replaceable, container size-dependent rotary indexing wheel positioning a container at a fill position from a receiving conveyance for filling the container with product while the container is engaged with the indexing wheel and transferring the filled container from the fill position to an outfeed conveyance, a replaceable, container size-dependent guide guiding the containers into engagement with the rotary indexing wheel and retaining the containers engaged with the rotary indexing wheel during the filling of the container and during transfer of the filled containers to the out-feed conveyor, a filler head disposed above the fill position in registry with the container to be filled, the filler head connected to a source of vacuum to remove the air from the container and also including an inlet nozzle for simultaneously delivering product into the evacuated container, and a control system for controlling and sequencing the operation of the rotary indexing wheel and the filler head.

In any of the embodiments described herein, wherein the rotary indexing system comprises a wheel defining a plurality of pockets for receiving the containers therein.

In any of the embodiments described herein, wherein the guide for guiding the containers into the pockets of the wheel retain the containers within the pockets of the wheel.

In any of the embodiments described herein, wherein the pockets comprise radially outwardly directed slots spaced about the exterior of the wheel.

In any of the embodiments described herein, wherein the slots are arcuate in shape, with a curvature corresponding to the curvature of the container.

In any of the embodiments described herein, wherein the guide restrains the container within a slot of the wheel while the wheel transfers the container from the receiving conveyance to the lift platform.

In any of the embodiments described herein, wherein the guide engages the containers to restrain the container within a slot of the wheel while the wheel transfers the container from the lift platform to the outfeed conveyance.

In any of the embodiments described herein, wherein the guide is configured for guiding a specific size container and the guide is removably mounted on a base structure for replacement with another guide configured for guiding a different size container.

In any of the embodiments described herein, wherein the guide structure has an arcuate portion defining a curved abutment edge to engage the exterior of the container.

In any of the embodiments described herein, wherein the curved abutment edge defines a curvature corresponding to a radius defined by the rotational center of the wheel and portion of the container furthest from the rotational center of the wheel.

In any of the embodiments described herein, wherein the guide structure comprises a lead-in portion to guide the container into engagement with the rotary indexing wheel.

In any of the embodiments described herein, further comprising a lift platform for supporting a container beneath the filling head during filling of the container, the lifting platform lifting the container upwardly into engagement with the filling head.

In any of the embodiments described herein, further comprising stops for limiting the elevation to which the lifting platform lifts the container to be filled relative to the filling head.

In any of the embodiments described herein, wherein the elevation of the container relative to the filling head controls the amount of product delivered to the container.

In any of the embodiments described herein, wherein the stops are mounted on movable brackets to raise and lower the stops to, in turn, control the elevation to which the lift platform lifts the container to be filled relative to the filling head.

In any of the embodiments described herein, further comprising a fill valve located between the source of vacuum and the filler head to connect and disconnect the source of vacuum from the filler head at a rate of at least thirty times per minute.

In any of the embodiments described herein, wherein the fill valve is actuated by compressed air.

In any of the embodiments described herein, wherein the fill valve comprising an angled seat valve.

In any of the embodiments described herein, wherein the angled seat valve is actuated by compressed air.

In any of the embodiments described herein, wherein the filler head comprises an inlet nozzle to direct product into the containers to be filled, the inlet nozzle having a lower end engageable within a container to be filled; and an outlet head is disposed at the lower end of the inlet nozzle, the outlet head having a plurality of apertures.

In any of the embodiments described herein, wherein the outlet head comprises portions defining an inwardly tapering funnel section terminating at an aperture of the outlet head.

In any of the embodiments described herein, wherein the filler head comprises portions defining an annular cavity surrounding a portion of the nozzle at the location of the nozzle head, the source of vacuum in communication with the annular cavity.

In any of the embodiments described herein, further comprising a fill valve located between the source of vacuum and the annular cavity to connect and disconnect the source of vacuum from the annular cavity at a rate of at least thirty times per minute.

In any of the embodiments described herein, wherein the fill valve comprising an angled seat valve.

In accordance with another embodiment of the present disclosure, a first method is provided for filling containers with product using the filling station described herein.

In accordance with another embodiment of the present disclosure, a filling station is provided for filling containers with product. The filling station includes a lift platform for supporting a container during filling, a rotary indexing system to position a container on the lift platform from a receiving conveyance for filling the container with product and transferring the filled container from the lift platform to an outfeed conveyance, a filler head disposed above the lift platform in registry with the container to be filled, an actuator lifting the lift platform to engage a container to be filled with the filler head and lowering the lift table to disengage the filled container from the filler head, the filler head connected to a source of vacuum to remove the air from the container and also including an inlet nozzle for simultaneously delivering product into the evacuated container, and a control system for controlling and sequencing the operation of the rotary indexing wheel, the lift platform, and the filler head.

In any of the embodiments described herein, wherein the rotary indexing system comprises a wheel defining a plurality of pockets for receiving the containers therein.

In any of the embodiments described herein, wherein the rotary indexing system further comprising a guide for guiding the containers into the pockets of the wheel and retaining the containers within the pockets of the wheel.

In any of the embodiments described herein, wherein the guide is configured for guiding a specific size container and the guide is removably mounted on a base structure for replacement with another guide configured for guiding a different size container.

In any of the embodiments described herein, wherein the pockets comprise radially outwardly directed slots spaced about the exterior of the wheel.

In any of the embodiments described herein, wherein the slots are arcuate in shape, with a curvature corresponding to the curvature of the container.

In any of the embodiments described herein, wherein the rotary indexing system further comprising a guide restraining the container within a slot of the wheel while the wheel transfers the container from the receiving conveyance to the lift platform.

In any of the embodiments described herein, wherein the guide engages the containers to restrain the container within a slot of the wheel while the wheel transfers the container from the lift platform to the outfeed conveyance.

In any of the embodiments described herein, wherein the guide comprises an arcuate portion defining a curved abutment edge to engage the exterior of the container.

In any of the embodiments described herein, wherein the curved abutment edge defines a curvature corresponding to a circle extending around the containers wherein each slot of the wheel is occupied by a container.

In any of the embodiments described herein, wherein the guide comprises a lead-in portion to guide the container into a pocket of the wheel.

In any of the embodiments described herein, wherein the guide is configured to match the diameter of the container, and the filling station further includes a base structure on which the guide structure is removably mounted and replaceable with a guide to match a container of a different diameter.

In any of the embodiments described herein, further comprising stops for limiting the elevation to which the lifting platform lifts the container to be filled relative to the filling head.

In any of the embodiments described herein, wherein the elevation of the container relative to the filling head controls the amount of product delivered to the container.

In any of the embodiments described herein, wherein the stops are mounted on movable brackets to raise and lower the stops to, in turn, control the elevation to which the lift platform lifts the container to be filled relative to the filling head.

In any of the embodiments described herein, further comprising a fill valve located between the source of vacuum and the filler head to connect and disconnect the source of vacuum from the filler head at a rate of at least thirty times per minute.

In any of the embodiments described herein, wherein the fill valve is actuated by compressed air.

In any of the embodiments described herein, wherein the fill valve comprising an angled seat valve.

In any of the embodiments described herein, wherein the angled seat valve is actuated by compressed air.

In accordance with another embodiment of the present disclosure, the filling station comprises a filler head. The filler head includes an inlet nozzle to direct product into the containers to be filled, the inlet nozzle having a lower end engageable within a container to be filled, and an outlet head is disposed at the lower end of the inlet nozzle, the outlet head having a plurality of apertures.

In any of the embodiments described herein, wherein the outlet head comprises portions defining an inwardly tapering funnel section terminating at an aperture of the outlet head.

In any of the embodiments described herein, wherein the filler head comprises portions defining an annular cavity surrounding a portion of the nozzle at the location of the nozzle head, the source of vacuum in communication with the annular cavity.

In any of the embodiments described herein, further comprising a fill valve located between the source of vacuum and the annular cavity to connect and disconnect the source of vacuum from the annular cavity at a rate of at least thirty times per minute.

In any of the embodiments described herein, wherein the fill valve comprises an angled seat valve.

In accordance with another embodiment of the present disclosure, a second method is provided for filling containers with product using the filling station as described herein.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
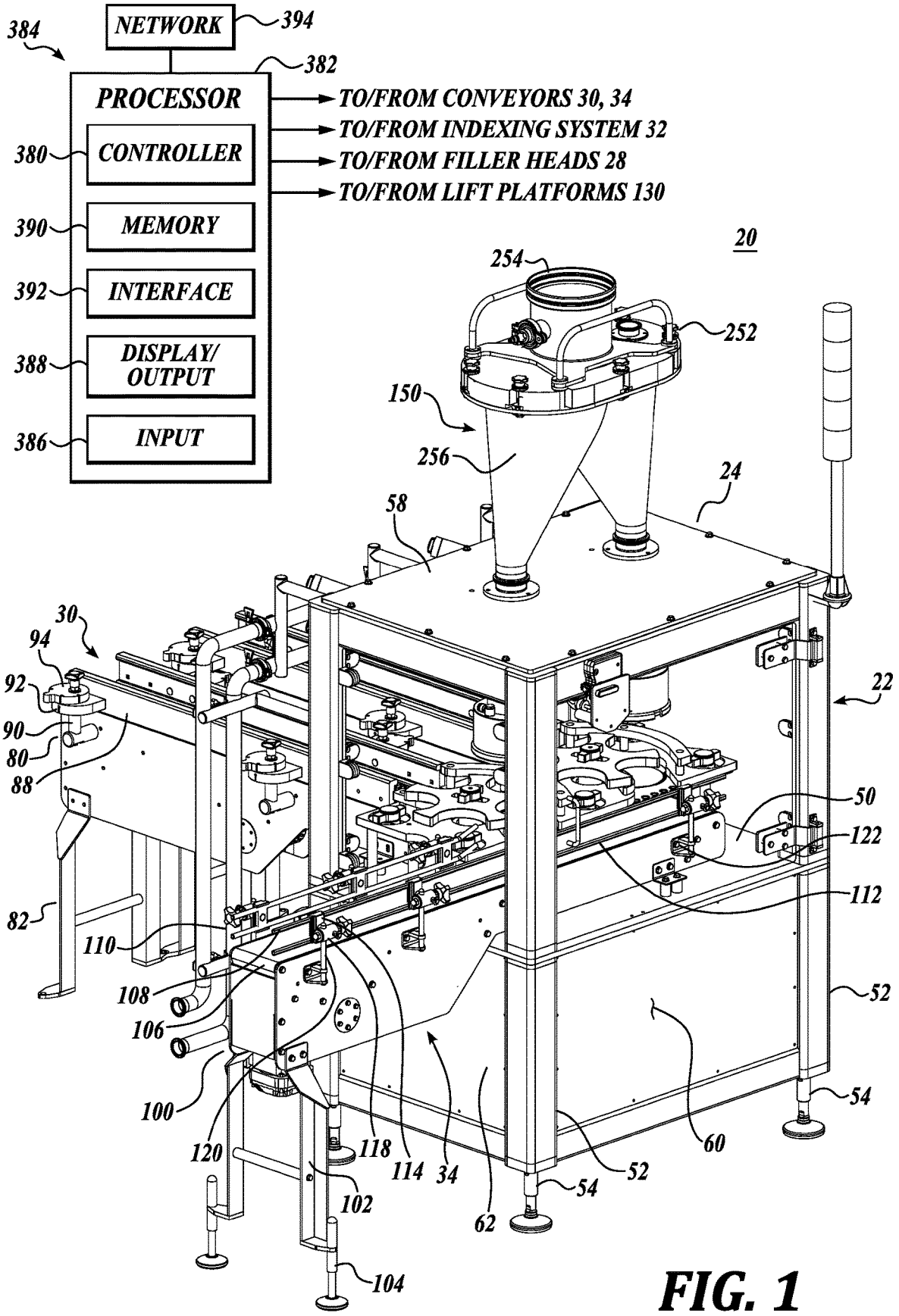
FIG. 1 is a pictorial view of the vacuum filling system of the present disclosure.

Various example embodiments of the present disclosure are described below with reference to the accompanying drawings in which some example embodiments are illustrated. In the FIGURES, the thicknesses of lines, layers, and/or regions may be exaggerated for clarity.

While example embodiments are capable of various modifications and alternative forms, embodiments thereof are shown by way of example in the FIGURES and are described in detail below. It should be understood, however, that there is no intent to limit example embodiments to the particular forms disclosed, but on the contrary, example embodiments are to cover all modifications, equivalents, and alternatives falling within the scope of the disclosure.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be considered in the specific context this definition is given herein.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

The present application may include references to directions, such as "forward," "rearward," "front," "back," "ahead," "behind," "upward," "downward," "above," "below," "top," "bottom," "right hand," left hand," "in," "out," "extended," "advanced," "retracted," "proximal," "distal," "central," "vertical," etc. These references and other similar references in the present application are only to assist in helping describe and understand the present invention and are not intended to limit the present invention to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out. If a quantitative value is needed to render the applicable parameter sufficiently definite, the applicable parameter is within five percent (5%) of the designated parameter value.

In the following description, various embodiments of the present disclosure are described. In the following description and in the accompanying drawings, the corresponding systems assemblies, apparatus and units may be identified by the same part number, but with an alpha suffix or by a prime ("') or double prime ("") or even a triple prime ("""') designation. The descriptions of the parts/components of such systems assemblies, apparatus, and units that are the same or similar may not repeated so as to avoid redundancy in the present application.

Referring initially to FIGS. 1-6, in basic form a filling station or apparatus 20 is illustrated as including a filler table structure 22 that may be disposed within a protective and supporting main housing 24. The filler table structure 22 receives and supports containers 26 to be filled with product from filler heads 28 positioned above the filler table structure. The containers 26 to be filled arrive at the filler table structure 22 on infeed or receiving conveyances 30 and then are precisely positioned at a filling position beneath the filler heads 28 by indexing systems 32. Thereafter, the filled containers 26 are transferred by the indexing systems 32 to an outfeed conveyance 34. Each filler head 28 is capable of cycling at a speed of at least 30 times per minute, whereby the filling station 20 is capable of filling containers 26 at a rate of at least 30 containers per minute per filler head.

Next describing the filling station or apparatus 20 in greater detail, the filler table structure 22 includes a shelf 50 or similar structure mounted within the housing 24 at an elevation intermediate the height of the housing. The shelf 50 is supported by corner legs 52 of the housing. Elevation adjustment feet 54 are provided at the bottom of the legs 52 so as to be able to adjust the height of the housing 24 as well as to level the housing relative to the floor. A bottom panel 56 and a top panel 58 can be used to close off the bottom and top of the housing 24.

Side panels are provided to form the vertical sides of the housing 24, for example, panels 60 and 62. The side panels can be mounted to the structure 22 using hinges so as to provide convenient access to the interior of the housing 24.

A control housing 70 is mounted on one side of main housing 24 to house and protect the electrical and other components of the filling station 20. A control panel 72 is mounted on the sloped upper surface 74 of the control housing 70 through which the filling station 20 can be operated. Alternatively, or in addition, the filling station 20 can be operated and controlled remotely.

Figure 2:
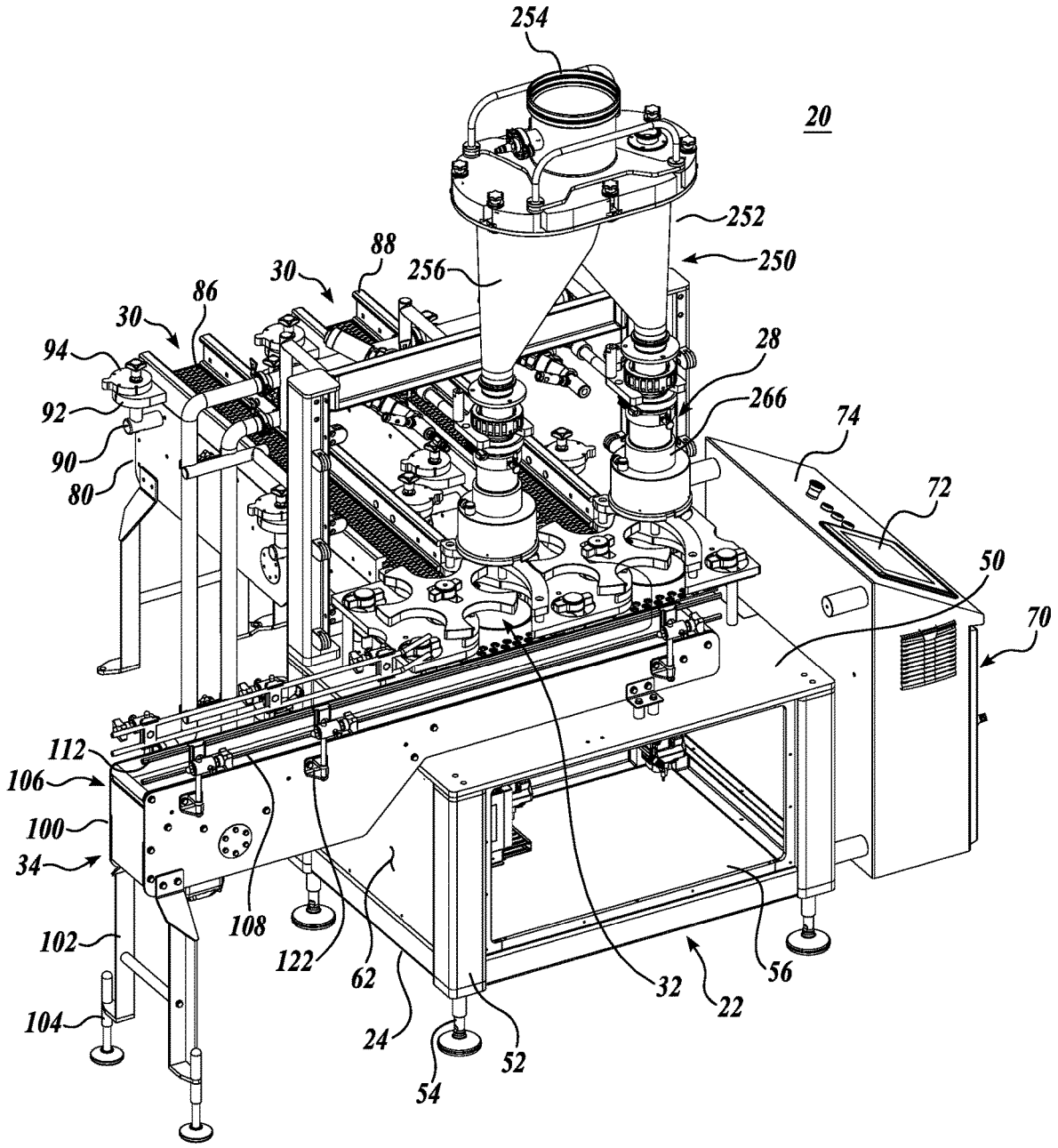
FIG. 2 is a view similar to FIG. 1 but with components removed so as to reveal the components of the vacuum filling system.
Figure 3:
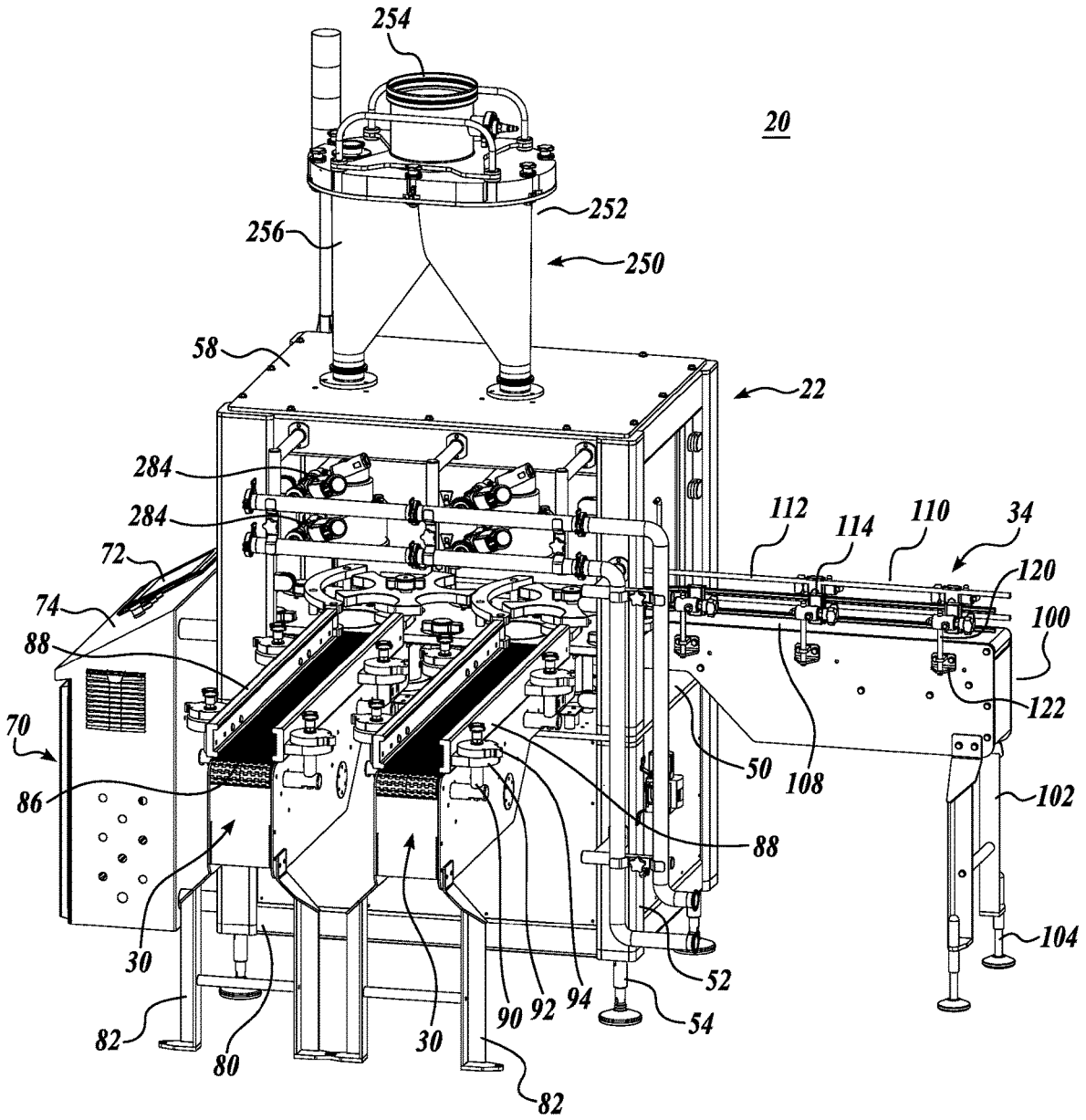
FIG. 3 is a pictorial view similar to FIG. 2 but taken from the opposite side of the vacuum filling system.
Figure 4:
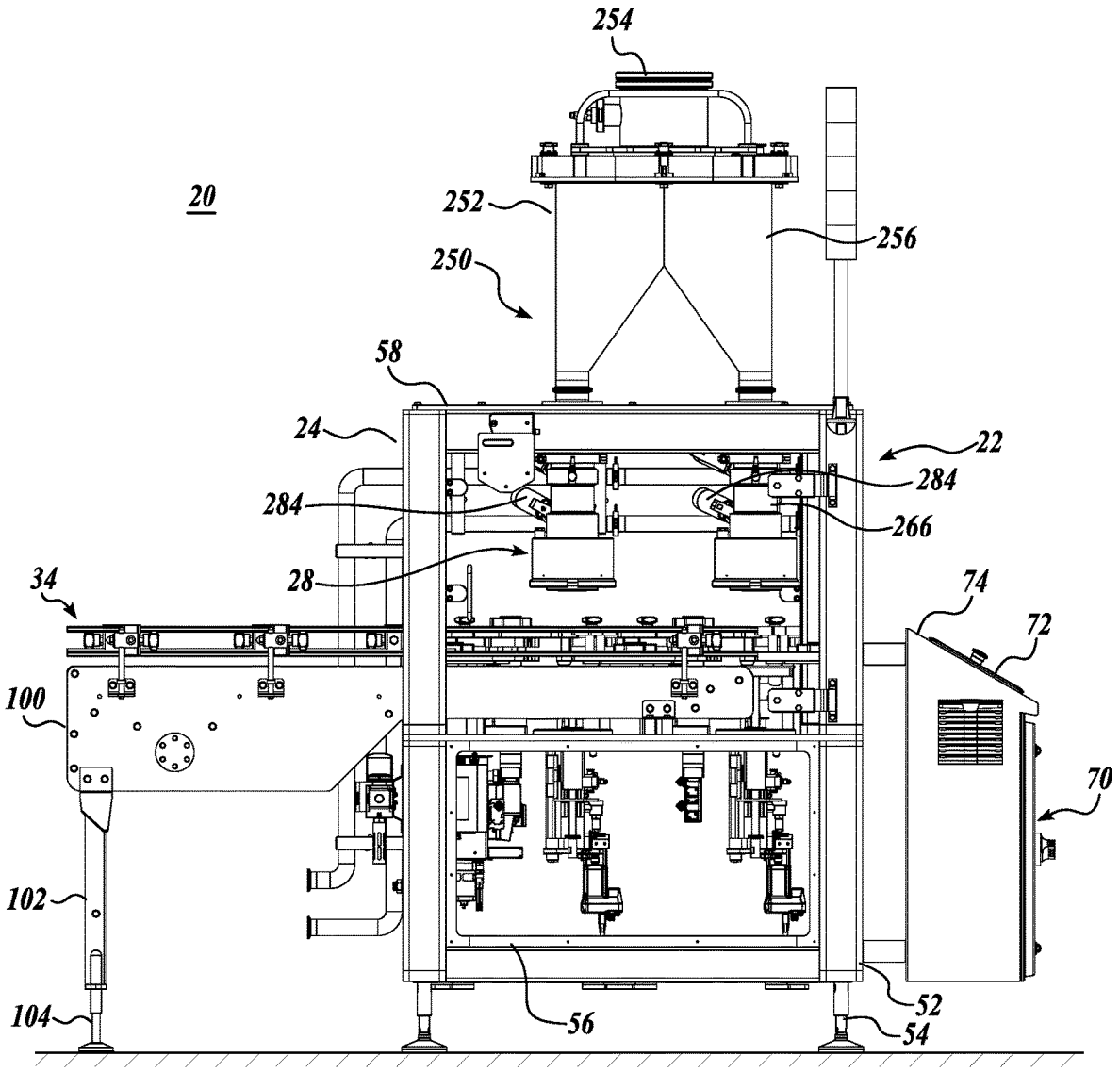
FIG. 4 is an elevational view of the vacuum filling system of FIGS. 1-3.

As perhaps most clearly shown in FIGS. 1-3, the receiving conveyances 30 each include a frame structure 80 supported by legs 82 at its distal end, and supported by the shelf 50 at its proximal end adjacent an indexing system 32. Vertically adjustable feet may be provided at the bottom of legs 82 so as to adjust the height of the distal end of the receiving conveyances 30.

The conveyances 30 each includes an endless powered belt 86 on which the containers 26 are delivered to the indexing systems 32. The powered belts 86 can be driven in a standard manner, for example, by electrical motors which are controllable in speed.

Sidewall structures 88 extend along each side of the powered belts 86 so as to laterally constrain the containers 26. The sidewall structures 88 are mounted to posts 90 extending upwardly from stub shafts projecting from the sides of the conveyance frame structure 80. Mounting brackets 92 extending laterally from the sidewall structures. The brackets 92 include longitudinal slots that engage over the post 90.

The lateral position of the sidewall structures is adjustable by adjustment cams 94 which are pivotally pinned to the brackets 92 and also are rotatably mounted on the post 90. Rotation of the cam 94 adjusts the position of the post within the bracket slot and thus the position of the sidewall structure 88 relative to the adjacent side of the belt 86. In this manner, the width of the conveyance 30 can be adjusted to correspond to the size (width or diameter) of the containers 26 being filled.

Referring to FIGS. 1-4, the outfeed conveyance 34 may be constructed somewhat similarly to the receiving conveyances 30. In this regard, the outfeed conveyance 34 includes a frame structure 100 having approximal end attached to the table structure shelf 50 and a distal end projecting outwardly from the housing 24. The distal end of the outfeed conveyance frame structure 100 is supported by a pair of legs 102. Vertically adjustable feet 104 are provided at the bottom the legs 102 so as to adjust the height of the distal end of the outfeed conveyance 34.

The outfeed conveyance 34 also includes an endless powered belt 106 on which filled containers 26 are transported away from the filling station 20. The powered belt 106 can be driven in a standard manner, for example, by electrical motors, which are controllable in speed.

As shown in the FIGS., the belt 106 is disposed at the elevation of the shelf 50 and one side edge of the belt is located closely adjacent the indexing system 32 so that the filled containers 26 can be transferred from the filling locations by the indexing system and onto the belt 106 and then transported away by the outfeed conveyance 34. In this manner, a single outfeed conveyance 34 can serve one or several filler heads. The speed of the belt 104 can be controlled to accommodate the number of containers being filled by the filler heads per unit of time, for example, the number of containers filled per minute.

Side fences 108 and 110 extend along the sides of belt 106. As illustrated, the side fences are composed of upper and lower rails 112 that are vertically supported by upright brackets 114. Stub shafts project laterally outwardly from the brackets 114 to engage with connectors 118 mounted on the upper ends of posts 120 which are secured to the conveyor frame structure 80 by outwardly projecting brackets 122. The connectors 118 can be loosened to adjust the position of the stub shafts and thus to locate the side fences relative to the adjacent edge of the endless belt 106. As in the receiving conveyance 30, the side fences 108 and 110 can be adjusted to correspond to the size (width or diameter) of the filled containers 26.

As noted above, the containers 26 to be filled preferably are precisely positioned at a filling position beneath the filler heads 28 by indexing systems 32. As discussed more fully below, a lift platform 130 is located at the filling position for lifting the empty containers 26 into engagement with the filler heads 28 to be filled, and thereafter lowering the filled containers down to the level of the outfeed conveyance 34, whereupon the indexing system 32 transfers the filled containers 26 on to the outfeed conveyance.

Next with respect to the indexing systems 32, stationary platforms 140, 142, and 144 are mounted above the level of shelf 50 by upright posts 146. The platforms 140, 142, and 144 are positioned relative to circular openings 148 formed in the shelf 50 for receiving a lift platform 130 therein. The stationary platforms 140, 142, and 144, support guides or guide structures 150, 152, and 154 thereon. Each of the guide structures 150, 152, and 154 is somewhat different in shape; however, the guide structures function to guide containers 26 as the containers are moved by rotary wheels, for example, in the form of star wheels 160, from the receiving conveyances 30 to fill positions beneath filler heads 28 for filling the containers, and then continue to guide the filled containers as the wheels rotate to move the filled containers from the filling positions to the out feed conveyance 34.

Figure 5:
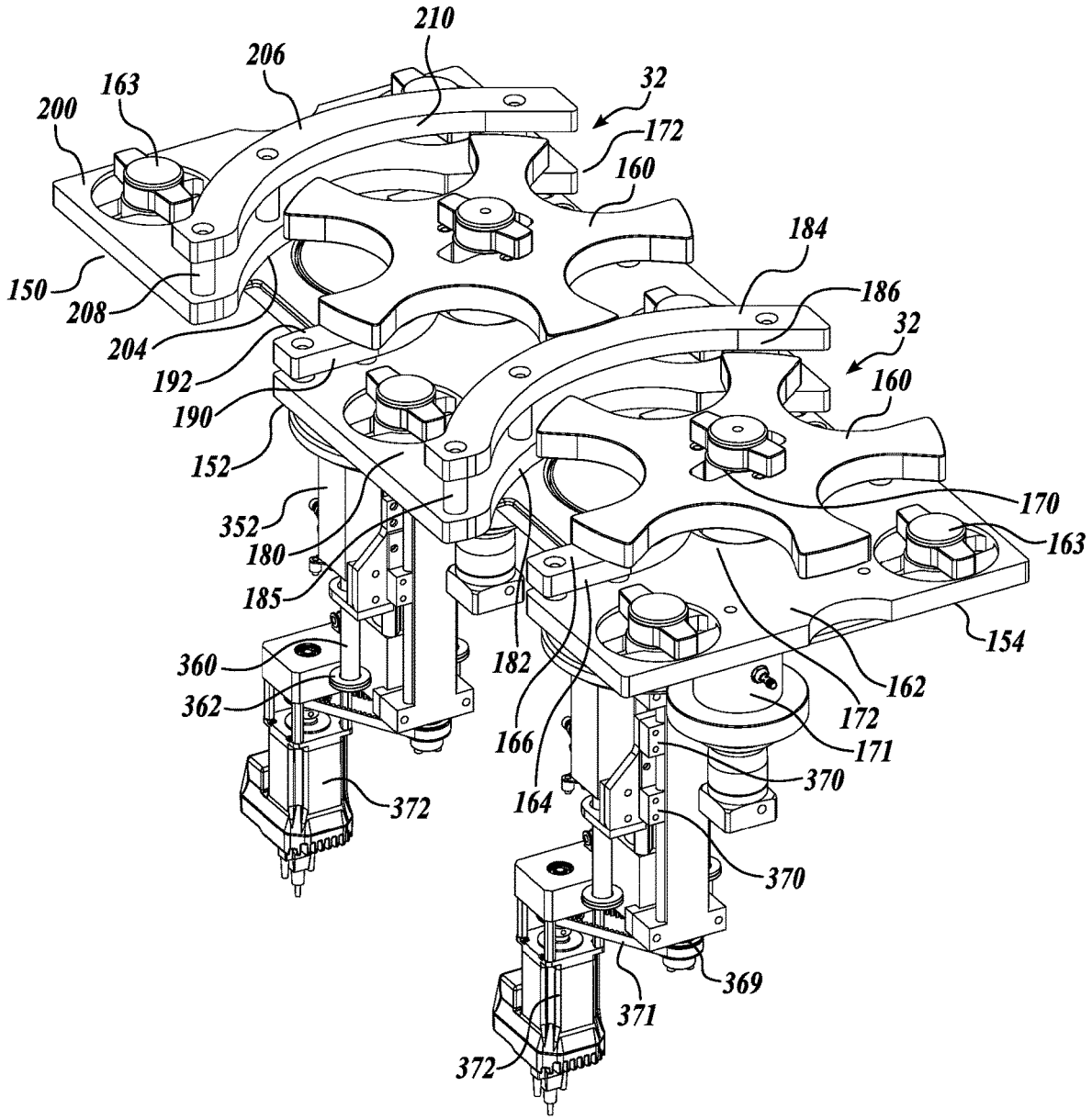
FIG. 5 is a pictorial view of a portion of the vacuum filling system.
Figure 6:
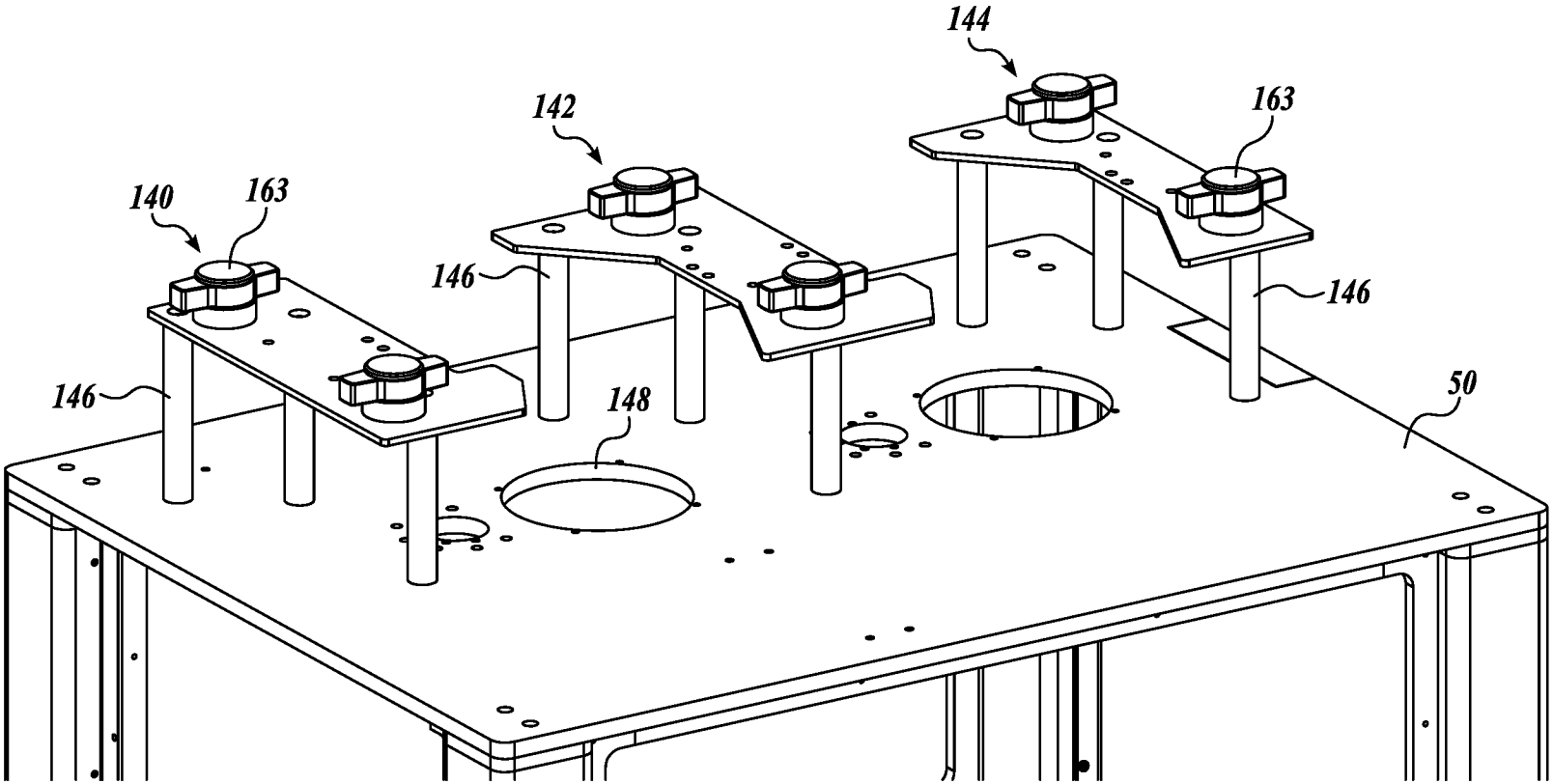
FIG. 6 is a pictorial view of another portion of the vacuum filling system.
Figure 7:
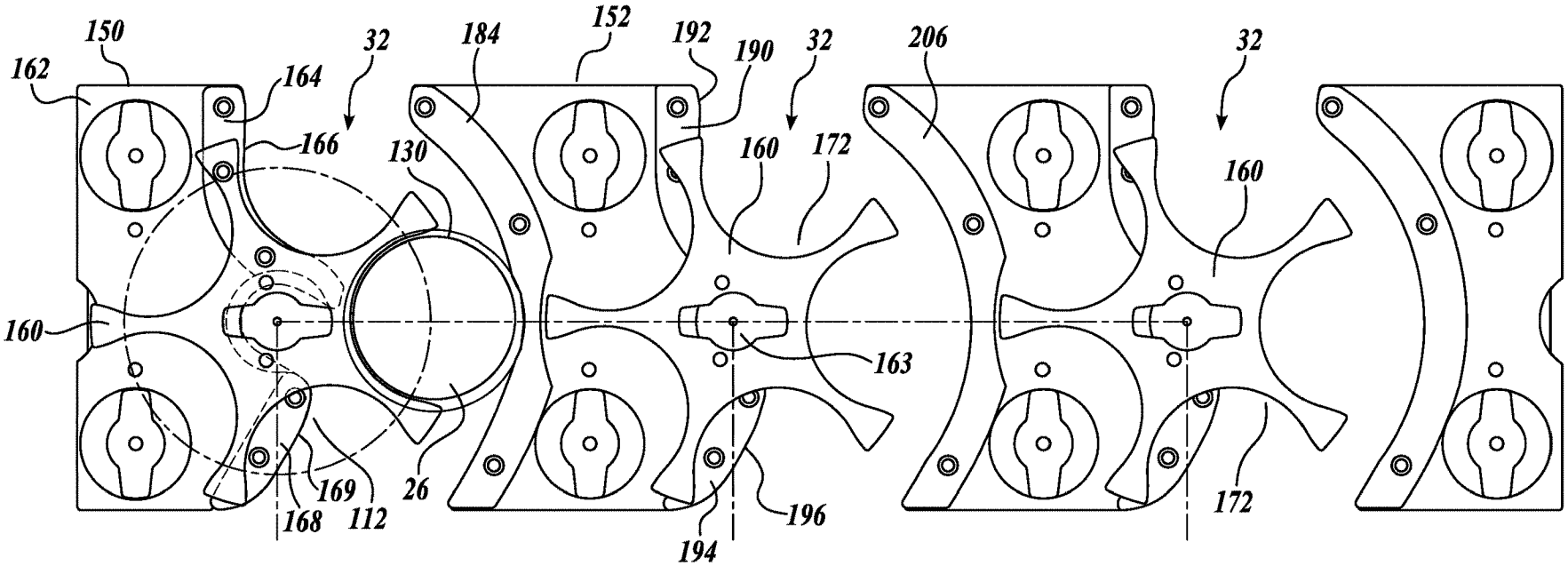
FIG. 7 is a fragmentary top view of a portion of the vacuum filling system.

Referring specifically to FIGS. 5-7, the guide structure 150 includes a base portion 162 which is mounted to the stationary platform 140 by wing screws (thumb screws) 163 which securely clamp the base portion 162 to the stationary platform 140. A curved inlet guide rail 164 lies on top of and extends along the perimeter of the base portion 162 to form an inlet abutment edge 166 along which the empty container 26 can slide as it is moved by the star wheel 160 from the receiving conveyance 30 to the lift platform 130. A curved outlet guide rail 168 lies on top of and extends along the perimeter of the base portion 162 to form an abutment edge 169 along which the filled container 26 can slide as it is moved by the star wheel 160 from the lift platform 130 to the outfeed conveyance 34. The guide rail 164 can include a short lead-in section adjacent the receiving conveyance to help guide the container into the path defined by the guide 150.

Figure 9:
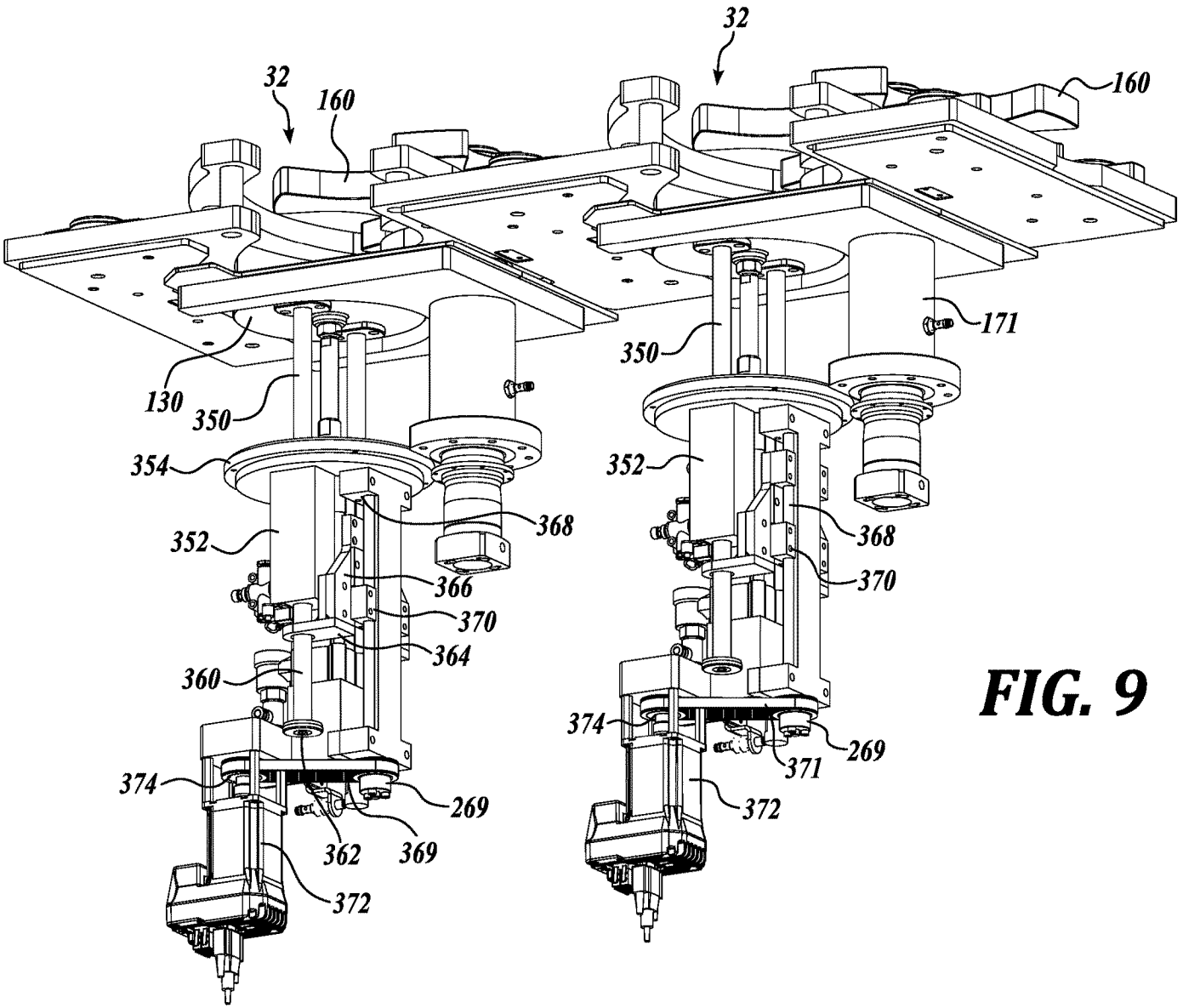
FIG. 9 is a fragmentary pictorial view of a portion of the vacuum filling system taken from below.
Figure 10:
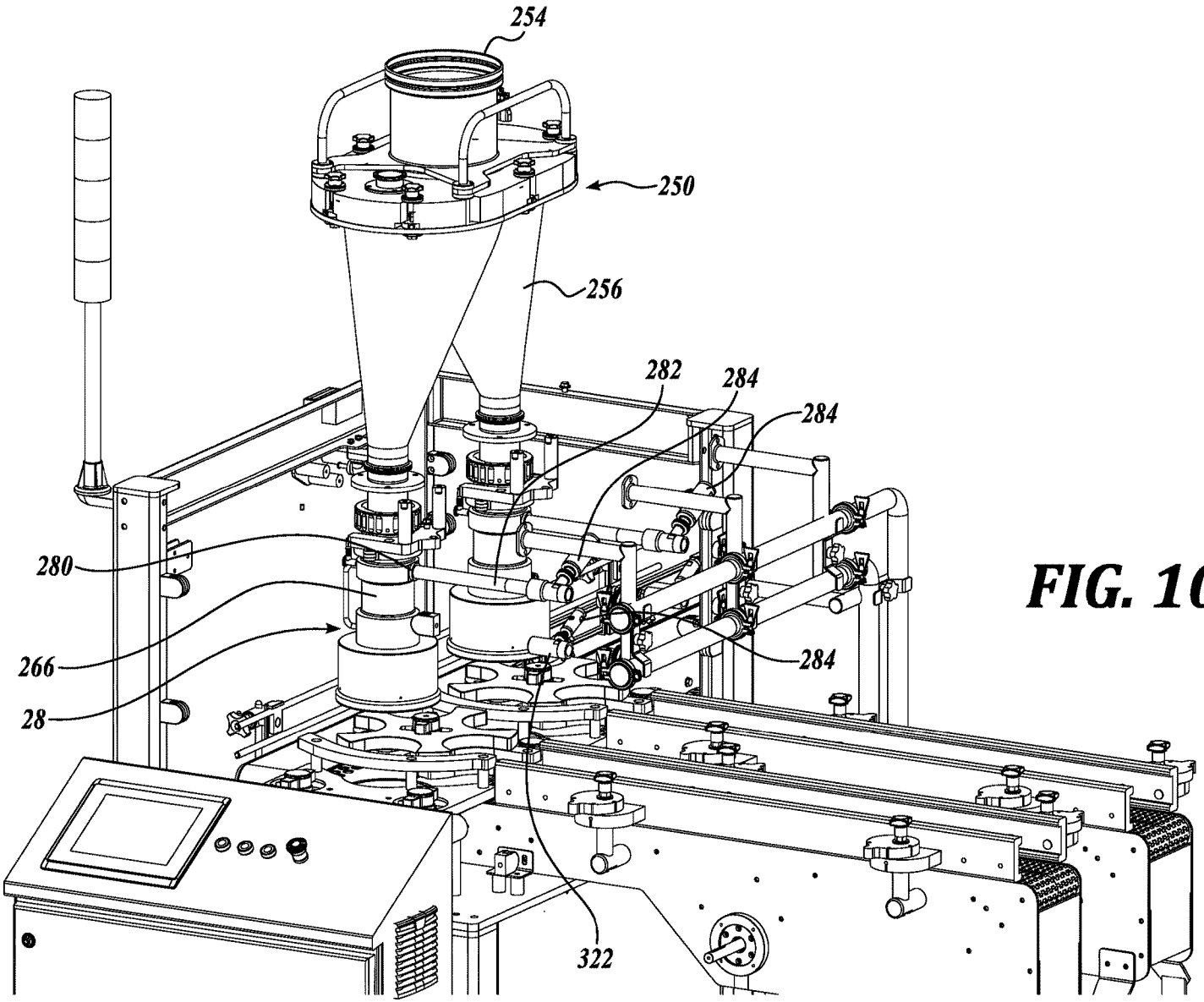
FIG. 10 is a fragmentary pictorial view of a portion of the vacuum filling system.

As also shown in FIGS. 5 and 7, the star wheel 160 is rotated above the guide structure 150 by a vertical rotatable axel 170 which extends through a clearance opening formed in the guide structure. The star wheel 160 is removably attached to the axle 170 by a wing screw 163 so as to be conveniently mounted to and detached from the rotating axle. The axle 170 projects upwardly from, and is powered by, a servo motor 171 mounted beneath shelf 50, see FIG. 9.

The star wheel 160 is constructed with seats or pockets 172 which may be in the shape of slots that define a segment of a circle corresponding to the diameter of the container 26. It will be appreciated that the slots are sized and positioned relative to the rotational center of the star wheel so that the container 26 nests closely within a slot as the empty container is moved by the star wheel 160 from the receiving conveyance 30 to the lift platform 130, as well as when the star wheel 160 moves the filled container from the lift platform to the outfeed conveyance 34, see FIG. 7.

The guide structure 152 includes a base portion 180 which is clamped to the top of the stationary platform 142 by two wing screws 163 in a manner similar to which the base portion 162 is clamped to the stationary platform 140, discussed above. The edge 182 of the base portion 180 facing the base portion 162 is curved in a generally arcuate shape to correspond to the path swept by the container outer circumference as the container is moved from the receiving conveyance 30 to the fill position by the star wheel 160, and then moved by the star wheel from the fill position to the outfeed convenience 34. However, such edge 182 of the base portion 180 may be relieved in the area of the lift platform 130 to provide clearance therefor.

An elevated guide rail 184 is supported above the base portion edge 182 by a series of posts 185 at an elevation corresponding to the elevation of the star wheel 160. The guide rail 184 defines in arcuate, concave abutment edge 186 along which the empty container 26 can slide as it is moved by the star wheel 160 from the receiving conveyance 30 to the lift platform 130 and then as the star wheel 160 moves the filled container from the lift platform to the outfeed conveyance 34. In this regard, also see FIG. 7. The abutment edge 186 is in the form of a segment of a circle defined by the outer surface of the container 26 furthest from the rotational center of the star wheel 160 as the container travels with the star wheel 160.

It will be appreciated that the guide rail 164 of the guide structure 150 and the elevated guide rail 184 of the guide structure 152 cooperatively define a precise path of travel for the container through the filling station. This path includes passing over the lift platform 130 where the container is positioned while it is being filled with product.

As shown in FIG. 7, as the filled container 26 exits the filler table structure, the container is moving in a direction both laterally toward the outfeed conveyance 34 and also in the direction of travel of the conveyance 34. Thus, the container intersects the conveyance 34 at an angle corresponding to the travel direction of the conveyance. As such, there is a smooth transition of the container 26 on to the endless belt 86 of the conveyance 34.

The opposite side of the guide structure base portion 180 serves the same function as the base portion 162 of the guide structure 150. To this end, a curved inlet guide rail 190 lies on top of and extends along the perimeter of the base portion 180 to form an inlet abutment edge 192 along which the empty container 26 can slide as it is moved by the star wheel 160 from the receiving conveyance 30 to the lift platform 130. Correspondingly, a curved outlet guide rail 194 lies on top of and extends along the perimeter of the base portion 180 to form an outlet abutment edge 196 along which the empty container 26 can slide as it is moved by the star wheel 160 from the lift platform 130 to the outfeed conveyance 34.

As shown in FIGS. 5 and 7, a star wheel 160 also is rotated above the guide structure 152 by a vertical axle 170 which extends through a clearance opening formed in the guide structure 152. The star wheel 160 is fixed to the axle 170 by a wing screw 163 so as to be conveniently mounted to and detached from the rotatable axle. As noted above, the axle 170 projects upwardly from and is powered by a stepper motor 171 mounted beneath shelf 50.

The guide structure 154 is constructed and shaped to function as the portion of the guide structure 152 that faces the guide structure 150, as discussed above. To this end, the guide structure 154 includes a base portion 200 which is mounted to the stationary platform 144 using wing screws 163, in the manner described above.

The base portion 200 defines an edge 204 facing the adjacent side of base portion 180. The edge 204 is curved in a generally arcuate shape to correspond to the path swept by the container outer circumference as the container is moved from the receiving conveyance 30 to the fill position by the star wheel 160 and then moved by the star wheel from the full position to the outfeed convenience 34. However, such edge 182 of the base portion 180 may be relieved in the area of the lift platform 130 to provide clearance therefor.

An elevated guide rail 206 may be supported above the base portion 200 by a series of posts 208 at an elevation corresponding to the elevation of the corresponding star wheel 160. The guide rail 206 defines in arcuate, concave abutment edge 210 above base portion edge 204, along which the empty container 26 can slide as it is moved by the star wheel 160 from the receiving conveyance 30 to the lift platform 130 and then as the star wheel 160 moves the filled container from the lift platform to the outfeed conveyance 34. In this regard, also see FIG. 7. The abutment edge 210 is in the form of a segment of a circle defined by the outer surface of the container 26 furthest from the rotational center of the star wheel 160 as the container travels with the star wheel 160.

It will be appreciated that the guide rail 190 of the guide structure 152 and the elevated guiderail 206 of the guide structure 154 cooperate to define a precise path of travel for the container through the filling station. This path includes passing over the lift platform 130 where the container is positioned while it is being filled with product.

Figure 8:
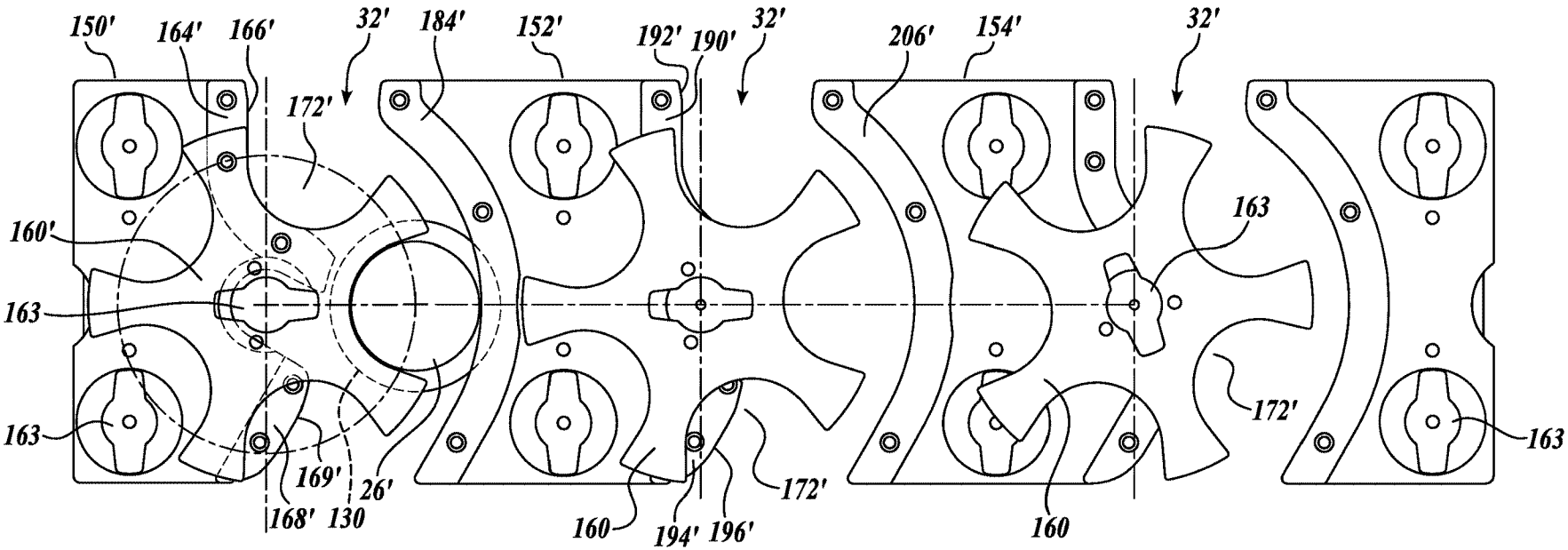
FIG. 8 is a view similar to FIG. 7 of a top view of a portion of the vacuum filling system for filling containers of a different size.

It will be appreciated that the guide structures 150, 152, and 154 shown in FIG. 7, as well as the star wheel 160, are configured to match the size (width or diameter) of the container 26. FIG. 8 illustrates guide structures and star wheels configured to accommodate a container 26' that is of smaller size (width or diameter) than the container 26 shown in FIG. 7. The guide structures and star wheels shown in FIG. 8 are identified by the same part numbers as the guide structures and star wheels shown in FIG. 7, but with the addition of a prime (') designation.

It will be appreciated that in FIG. 8 the same lift platform 130 is employed as well as the same stationary platforms 140, 142, and 144. However, the guide structures 150', 152', and 154' are modified from the corresponding components shown in FIG. 7 to accommodate the smaller diameter container 26' shown in FIG. 8. Correspondingly the star wheels 160' shown in FIG. 8 are also modified from the star wheels 160 shown in FIG. 7 to accommodate the smaller diameter container 26'. Nonetheless, the guide structures and star wheels shown in FIG. 8 are shaped similarly and function in the same manner of the guide structures and star wheels shown in FIG. 7 and described above.

It will further be appreciated that the guide structures 150, 152, and 154 shown in FIG. 7 can be conveniently and quickly removed by simply loosening the wing screws 163. Thereafter, the guide structures 150', 152', and 154' can be mounted in place by simply retightening the wing screws. Similarly, the star wheels 160 shown in FIG. 7 can be quickly replaced by loosening wing screws 163 and removing the star wheels 160 and then retightening the wing screws after the star wheels 160' have been mounted on the upper ends of axles 170.

Of course, guide structures and star wheels other than those shown in FIGS. 7 and 8 can be employed so as to accommodate containers of sizes different than containers 26 and 26.' The filling station 20 of the present disclosure is able to accommodate containers having diameters from about 99 mm to about 153 mm.

Next referring specifically to FIGS. 10-13, a filler assembly 250 is used to fill the containers 26 with product, which may be in the form of powder, granular or other dry, flowable material. In basic form, the filler assembly 250 includes an upper feed section 252 which supplies the product to lower filler heads 28 which engage with the containers 26, as described below.

The upper feed section 252 includes an inlet tube 254 which is connectable to a product supply source, not shown. A manifold 256 directs the product from the inlet tube 254 to the upper portion of two filler heads 28.

The filler head 28 includes an inner tubular member 260 that is in product flow communication with the upper feed suction 252. The inner tubular member 260 functions as an inlet nozzle and extends to the bottom of the filler head 28.

Figure 11:
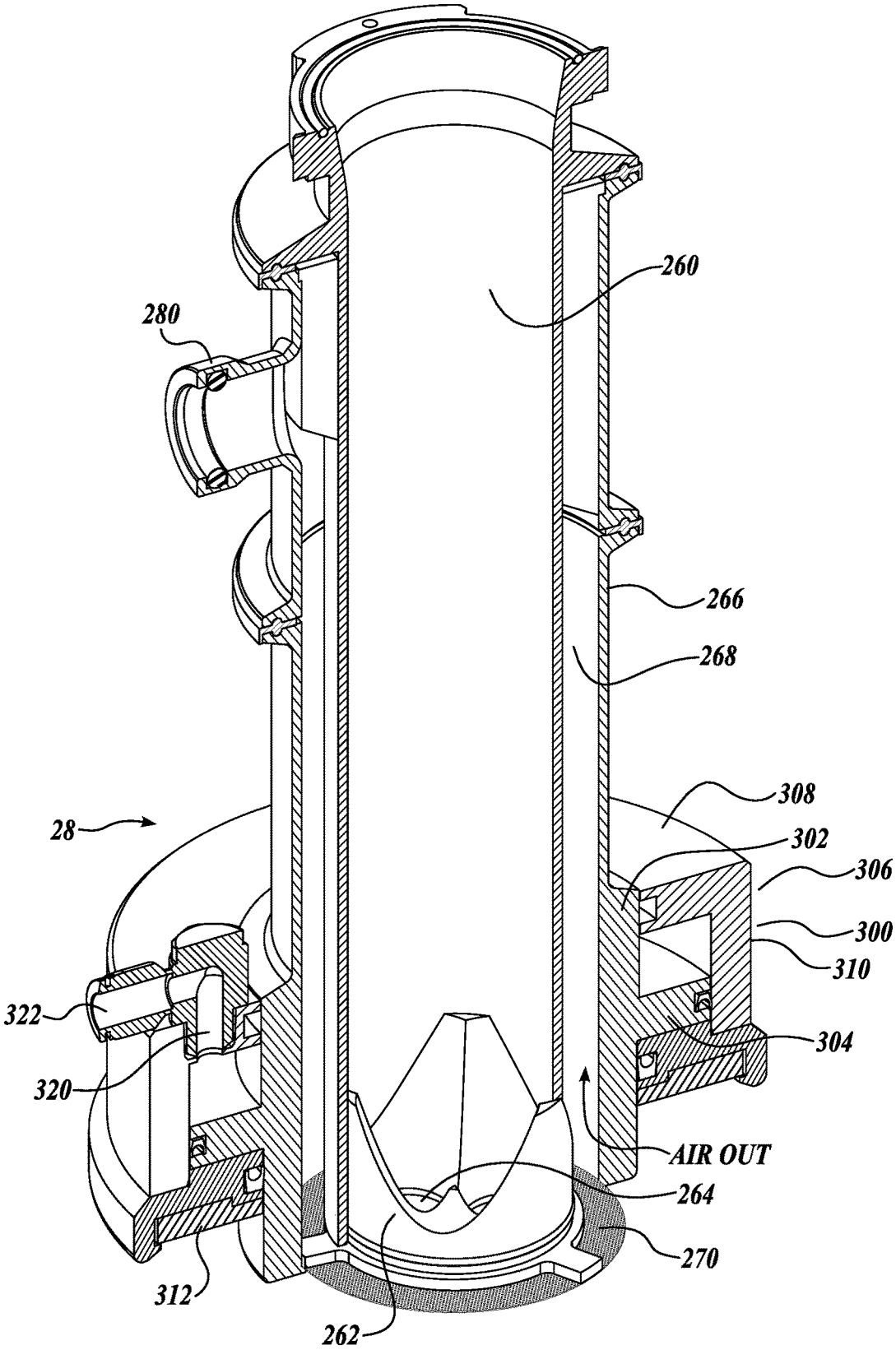
FIG. 11 is a fragmentary cross-sectional view of a portion of the filler head.
Figure 12B:
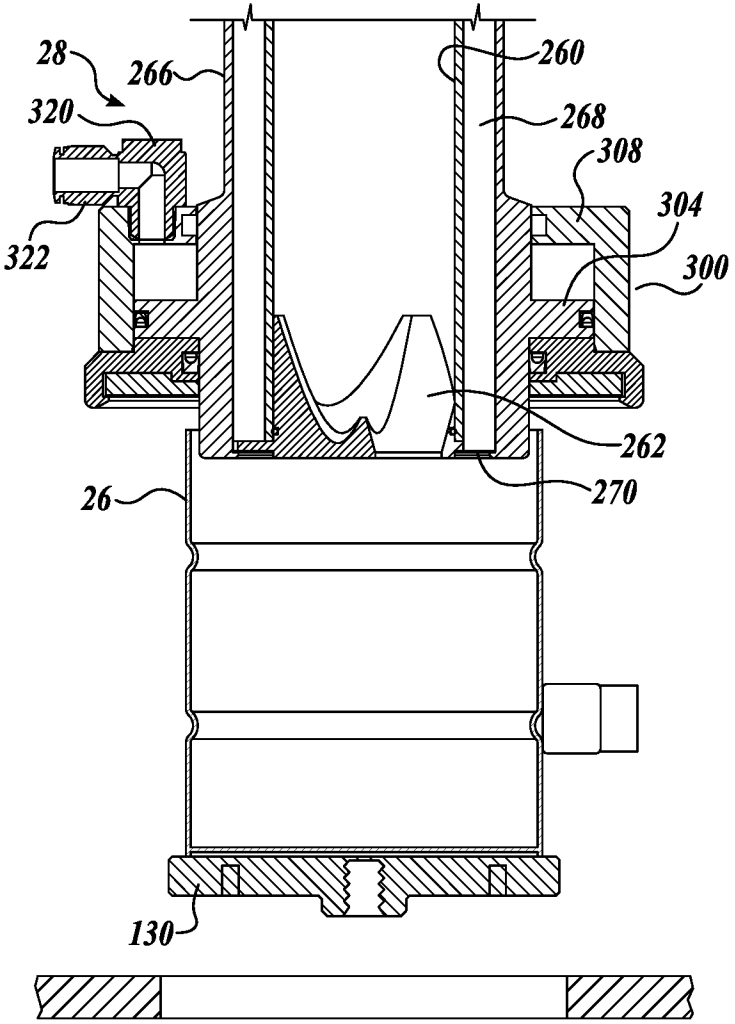
FIG. 12B is a view similar to FIG. 12A, showing the filler head in different position.
Figure 12A:
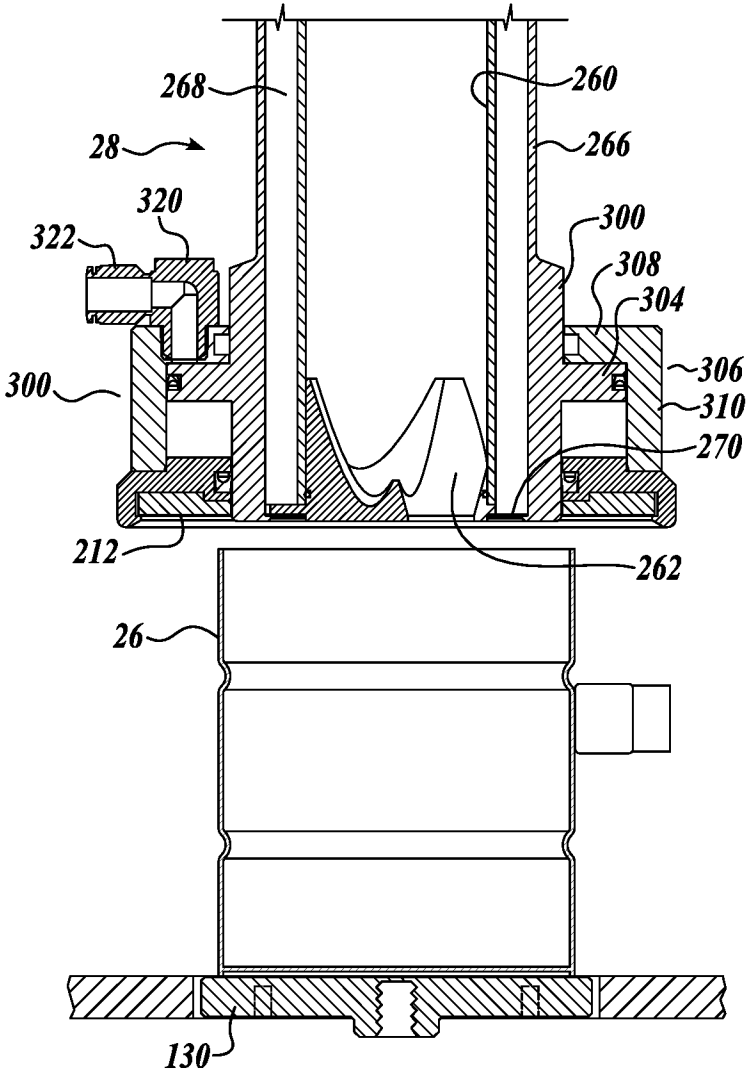
FIG. 12A is a cross sectional view of the filler head portion of the vacuum filling system.
Figure 13:
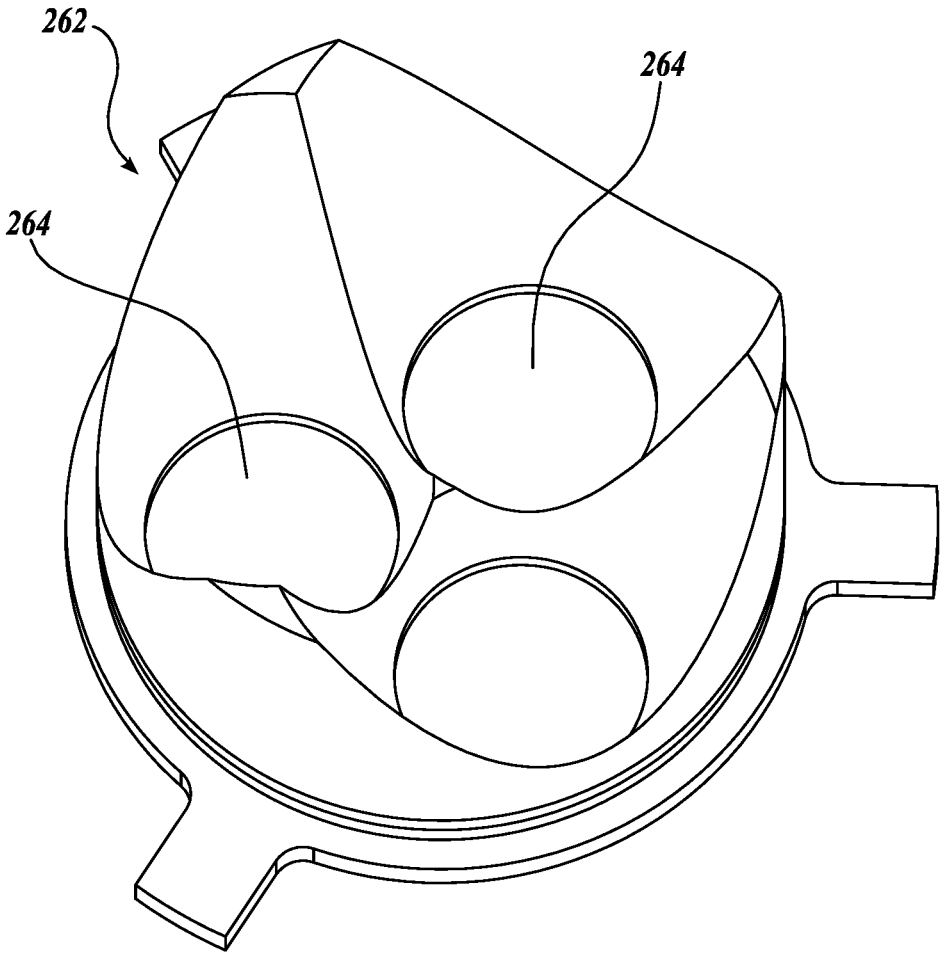
FIG. 13 is a pictorial view of a component of the filler head.

An outlet head 262 is positioned at the lower end of the inner tubular member 260. The outlet head is constructed with three circular outlet openings 264 through which the product flows from the tubular member and into the containers 26 during filling. As shown in FIGS. 11-13, the outlet head 262 includes funnel-shaped lead ins that terminate at the openings 264. Applicant has found that by this construction the product freely flows out of the bottom of the tubular member 260, but facilitates the bridging of the product when it is desired that the product flow cease.

An outer tubular member 266 surrounds the inner tubular member 260 to define an annular chamber 268 between the two tubular members. The lower end of the outer tubular member 266 is co-terminus with the lower end of the inner tubular member 260. A ring 270 of porous material is interposed between the inside surface of the outer tubular member 266 and the exterior surface of the inner tubular member 260 at the bottoms thereof thereby to occupy the annular space between the inner and outer tubular members.

A vacuum fitting 280 is located in an upper portion of the outer tubular member 266. This fitting is connected to a tube 282 that projects laterally from the filler head 28, which in turn is in communication with a vacuum source. A fill valve 284 is interposed in tube 282 to control the flow of vacuum to the annular chamber 268, see FIG. 3. Preferably the fill valve 284 is operated by compressed air so as not to require vacuum from the source utilized to operate the filler head 28. In this regard, the fill valve can be in the form of an angled seat valve.

One advantage of an angled seat valve is its ability to operate at fast cycle speeds without significant flow restriction. In this regard, the fill valve 284 is required to operate within two second cycles, in other words to open and close 30 times a minute, which is in the operational realm of angled seat valves. Of course, other types of valves may be utilized which also meet these operational parameters.

As discussed more fully below, when a vacuum is imposed within the annular chamber 268, air is removed from the container 26 and replaced with product from the inner tubular member 260. When the container 26 is filled with product, the vacuum to the annular chamber 268 is automatically terminated and the flow of product to the container also automatically terminates.

A clamping head 300 is located at the bottom of the outer tubular member 266. The clamping head 300 surrounds the tubular member 266. A ring section 304 extends transversely from the tubular member 266. A cover 306 is slidably engaged over the tubular member 266 and the ring section 304. In this regard, a cover 306 includes a top transverse section 308 and a cylindrical section 310 extending downwardly from the top section. The cylindrical section 310 fits closely over the exterior of the ring section 304. An elastic cover 312 extends between the bottom of the cylindrical section 310 and the bottom of the sleeve section 302. The clamping head 300 has vacuum applied to the internal chamber via a vacuum fitting 320, the vacuum pushes the clamping head 300 in a descending motion to apply pressure on the can being filled. This prevents the container being filled from lifting away from the lift platform 130 when vacuum is applied to the container.

A vacuum line fitting 320 is located in the transverse section 308 of the cover 306 for connection to a vacuum line 322. A fill valve 284 is interposed in the vacuum line 322 to control the vacuum to the clamping head 300 and thus the sealing of the filler head 28 to the containers 26. As discussed above, the fill valve 284 is capable of fast cycle speeds of at least 30 cycles per minute Next referring to FIG. 9, the lift platform 130 is shown as supported by a pair of lifting rods 350 projecting upwardly from actuator bodies 352 positioned beneath a mounting disc 354. The actuator bodies 352 are operable to extend and retract the lifting rods 350 to in turn raise and lower the lift platform 130 thereby to engage the container 26 carried by the lift platform with the lower end of the filler head 28, as discussed more fully below.

A control rod 360 extends downwardly from the actuator body 352. The control rod 360 can be an extension of the lifting rod 350 so as to move up and down with the lifting rod. A stop head 362 is a fixed to the lower end of the control rod. The stop head is of a diameter larger than the diameter of the control rod. The lower end of the control rod extends through a close-fitting opening formed in a stop bar 364 extending laterally from two slide brackets 366 adapted to move up and down along an upright guide rod 368. The guide rod 368 is threaded, and as such functions as lead screw which is engaged with internally threaded blocks 370 which are in turn attached to the slide brackets 366. A cog gear 369 is attached to the bottom of the guide rod 368 and is rotated by a cog belt 371 driven by a motor 372. The motor 372 has a cog gear 374 fixed to its output shaft. It will be appreciated that by the foregoing construction the stroke of the lifting rods 350 can be very precisely controlled (within 0.15 mm) by rotation of the guide rod.

Regarding the operation of the filling station 20, containers 26 to be filled are delivered to the filling station on the receiving conveyances 30. The empty containers 26 enter the pockets or seats 172 of the star wheels 160 as the pocket is in registry or alignment with the receiving conveyance 30. A number of empty containers 26 are "stacked up" on the receiving conveyance 30 at the star wheel 160. Thus, when an open pocket 172 is presented to the conveyance 30, an empty container 26 will automatically enter the pocket.

As discussed above the star wheel 160 transfers the empty container 26 from the receiving conveyance 30 to the lift platform 130. Thereafter, the lift platform raises the empty container 26 upwardly into engagement with the lower portion of the filler head 28, whereby the filler head extends downwardly into the interior of the container, as shown in FIG. 12B.

Next, the clamping head 300 is activated by applying a vacuum to the interior clamping head thereby forcing the clamping head 300 and elastic cover 306 downwardly against the top of the container causing a seal to be formed between the exterior of the filler head and the interior of the container.

Thereafter, a vacuum is applied to the annular chamber 268 which surrounds the inner tubular member 260 of the filler head. This vacuum forces the air in the container 26 upwardly through the porous ring 270, and into the annular chamber 268 and then out through the inlet tube fitting 280 and into to vacuum tube 282. As evacuation of the container is occurring, product in the inner tubular member 260 flows downwardly through the outlet head openings 264 and into the container 26. Such flow continues until the product reaches the level of the porous ring 270, whereupon flow of the product terminates, as well as the vacuum to the annular chamber 268. This filling process takes less than one second.

Thereupon, the vacuum in the clamping head 30 is released, thereby allowing the container 26 to disengage from the filling head so that the lift platform 130 can be lowered to the elevation of the shelf 50. A pinch valve 286 opens to atmosphere to allow the vacuum stored within the system to dissipate, see FIG. 10. Thereupon, the star wheel 160 transfers the filled container from the lift platform to the outfeed conveyance 34.

It will be appreciated that the container 26 during the entire time at the filling station 20 is engaged in a pocket 172 of the star wheel 160, including while the filled container 26 is being removed from the lift platform 130, and an empty container is being loaded onto the lift platform.

The process of lowering the filled container 26 from the filling head and transferring the filled container to the outfeed conveyance 34 takes less than a second. As such, the cycle time for filling a container and then removing the container from the filling station can be accomplished within two seconds.

The speed of operation of the filling station is made possible by the precise construction and operation of the filling station, including the use of star wheels 160 which remain engaged with the containers during the entire time the containers are at the filling station. Also, the star wheels, together with the guide structures, are capable of precisely positioning the containers on the lift platforms.

The speed of operation of the filling station 20 is also made possible by the fast-acting fill valves 284, which apply vacuum to the filler head annular chamber 268 as well as to the clamping head 300. As noted above, one type of valve capable of operating at the required speeds is an angled seat valve, which is operated by compressed air and not by vacuum.

As discussed above, if a container of a different size than container 26 is to be filled, the guide structures, such as guide structures 150, 152 and 154, can be quickly removed and replaced by guide structures configured for use with the new container. The same is true with respect to the star wheels. Star wheels, such as those described above, can be quickly removed from the vertical axle 170 and replaced with star wheels configured for use with the new container and the corresponding guide structures for the new container. As such, the filling station 20 of the present disclosure has the flexibility of accommodating a wide range of container sizes, while still being able to fill at least 30 containers per minute per fill head.

The conveyances 30 and 34, filler heads 28, the indexing systems 32, and the lift platform 130 are coupled to and controlled by a controller 380 operated by a processor 382 of a processing system 384, as schematically shown in FIG. 1. The processing system 384 includes an input device 386 (keyboard, mouse, touchpad, etc.) and an output device 388 (monitor, printer). The processing system 384 also includes a memory unit 390 and an interface 392 for receiving signals and information from the conveyances 30 and 34, filler heads 28, the indexing systems 32, and the lift platform 130, as well as from other data sources of system 20, as described more fully above. The processor 382 may be connected to a network 394. Also, rather than employing a local processor 382, a network computing system can be used for this purpose.

While illustrative embodiments have been illustrated and described, it will be appreciated that various changes can be made therein without departing from the spirit and scope of the invention. For example, in the description above and then the attached drawings two filler heads 28 are utilized. However, a filling station can employ a single filler head, such as filler head 28, or a larger number of filler heads, for example six or eight filler heads.

Also, although the star wheels 160 are described and illustrated above as utilizing five pockets or seats 172, depending on the size of the containers being filled the number of pockets maybe greater in number or fewer in number then the five illustrated in the attached drawings.

The embodiments of the invention in which an exclusive property or privilege is claimed are defined as follows:

1. A filling station for filling containers of different sizes with product, comprising:

a replaceable, container size-dependent rotary indexing wheel receiving a container from a receiving conveyance and positioning the container at a fill position for filling the container with product while the container is engaged with the rotary indexing wheel and then after the container has been filled while at the fill position transferring the filled container from the fill position to an outfeed conveyance;

a replaceable, container size-dependent stationary arcuate guide guiding the containers from the receiving conveyance into engagement with the rotary indexing wheel and retaining the containers engaged with the rotary indexing wheel during the filling of the container and during transfer of the filled containers to the out-feed conveyor;

a filler head disposed above the fill position in registry with the container at the fill position, the filler head connected to a source of vacuum to remove the air from the container and also including an inlet nozzle for simultaneously delivering product into the evacuated container; and a control system for controlling and sequencing the operation of the receiving conveyance, the rotary indexing wheel, the filler head, and the outfeed conveyance.

2. The filling station according to claim 1, wherein the rotary indexing wheel defines a plurality of pockets for receiving the containers therein.

3. The filling station according to claim 2, wherein the guide for guiding the containers into the pockets of the rotary indexing wheel retains the containers within the pockets of the rotary wheel.

4. The filling station according to claim 1, wherein the guide is configured for guiding a specific size container and the guide is removably mounted on a base structure for replacement with another guide configured for guiding a different size container.

5. The filling station according to claim 1, wherein the arcuate guide defines a curved abutment edge to engage the exterior of the container to enable the container to slide there along while being positioned and transferred by the rotary indexing wheel.

6. The filling station according to claim 1, further comprising a lift platform for supporting a container beneath the filling head during filling of the container, the lifting platform lifting the container upwardly into engagement with the filling head.

7. The filling station of claim 6, further comprising stops for limiting the elevation to which the lifting platform lifts the container to be filled relative to the filling head.

8. The filling station of claim 7, wherein the elevation of the container relative to the filling head controls the amount of product delivered to the container.

9. The filling station according to claim 1, further comprising a fill valve located between the source of vacuum and the filler head to connect and disconnect the source of vacuum from the filler head at a rate of at least thirty times per minute.

10. The filling station according to claim 9, wherein the fill valve is actuated by compressed air.

11. The filling station according to claim 1, wherein the filler head comprises:

an inlet nozzle to direct product into the containers to be filled, the inlet nozzle having a lower end engageable within a container to be filled; and an outlet head is disposed at the lower end of the inlet nozzle, the outlet head having a plurality of apertures.

12. The filling station according to claim 11, wherein the outlet head comprising portions defining an inwardly and downwardly tapering funnel section terminating at an aperture of the outlet head.

13. The filling station according to claim 11, wherein the filler head comprises portions defining an annular cavity surrounding a portion of the nozzle at the location of the nozzle head, the source of vacuum in communication with the annular cavity.

14. The filling station according to claim 13, further comprising a fill valve located between the source of vacuum and the annular cavity to connect and disconnect the source of vacuum from the annular cavity at a rate of at least thirty times per minute.

15. A method of filling containers with product using the filling station of claim 1.

* * * * *